US005769250A

United States Patent [19]

Jussila et al.

[11] Patent Number: 5,769,250

[45] Date of Patent: Jun. 23, 1998

[54] METHOD AND APPARATUS FOR CONTROLLING THE LOADING ELEMENT AND LOAD OF A CRANE

[75] Inventors: Olavi Jussila, Hyvinkää; Timo Sorsa, Jokela, both of Finland

[73] Assignee: KCI Konecranes International Corporation, Hyvinakaa, Finland

[21] Appl. No.: 817,500

[22] PCT Filed: Aug. 29, 1996

[86] PCT No.: PCT/FI96/00462

§ 371 Date: Apr. 15, 1997

§ 102(e) Date: Apr. 15, 1997

[87] PCT Pub. No.: WO97/08094

PCT Pub. Date: Mar. 6, 1997

[30] Foreign Application Priority Data

Aug. 30, 1995 [FI] Finland ..... 954062

[51] Int. Cl.[6] ..... B66C 13/06

[52] U.S. Cl. ..... 212/274; 294/81.4

[58] Field of Search ..... 294/81.3, 81.4; 212/274, 275, 319

[56] References Cited

U.S. PATENT DOCUMENTS

| | | | |
|---|---|---|---|
| 3,743,107 | 7/1973 | Verschoof | 212/274 |
| 4,705,180 | 11/1987 | Lamer et al. | 294/81.4 |

FOREIGN PATENT DOCUMENTS

| | | | |
|---|---|---|---|
| 638510 | 8/1994 | European Pat. Off. . | |
| 54789 | 3/1972 | Finland . | |
| 96677 | 7/1994 | Finland . | |
| 2115587 | 3/1971 | Germany . | |
| 2203245 | 1/1972 | Germany . | |
| 2316947 | 4/1973 | Germany . | |
| 1424870 | 2/1976 | United Kingdom | 212/274 |
| 94/11293 | 5/1994 | WIPO | 212/275 |

*Primary Examiner*—Thomas J. Brahan

[57] ABSTRACT

A method and apparatus for controlling a loading element suspended from lifting drums of a crane by lifting ropes, and a load attached to the loading element. The controlling referring to damping horizontal sway and skew of the loading element and precision positioning the same in the horizontal direction and in the direction of skew by use of a control apparatus comprising control mechanisms mounted in the crane and provided with motors, and four auxiliary ropes between the control mechanisms and the loading element The method comprising the loading element by moving the auxiliary ropes by means of control mechanisms. The control is implemented by four identical mechanisms provided with rope drums, devices for weighing the rope force and/or tachometers and motor control devices, each of the four mechanisms being connected to one auxiliary rope, and four identical control logic circuits connected to each mechanism for controlling by motors the forces exerted on the auxiliary ropes to prevent the load element from swaying.

26 Claims, 4 Drawing Sheets

METHOD AND APPARATUS FOR CONTROLLING THE LOADING ELEMENT AND LOAD OF A CRANE

BACKGROUND OF THE INVENTION

Figure 1:
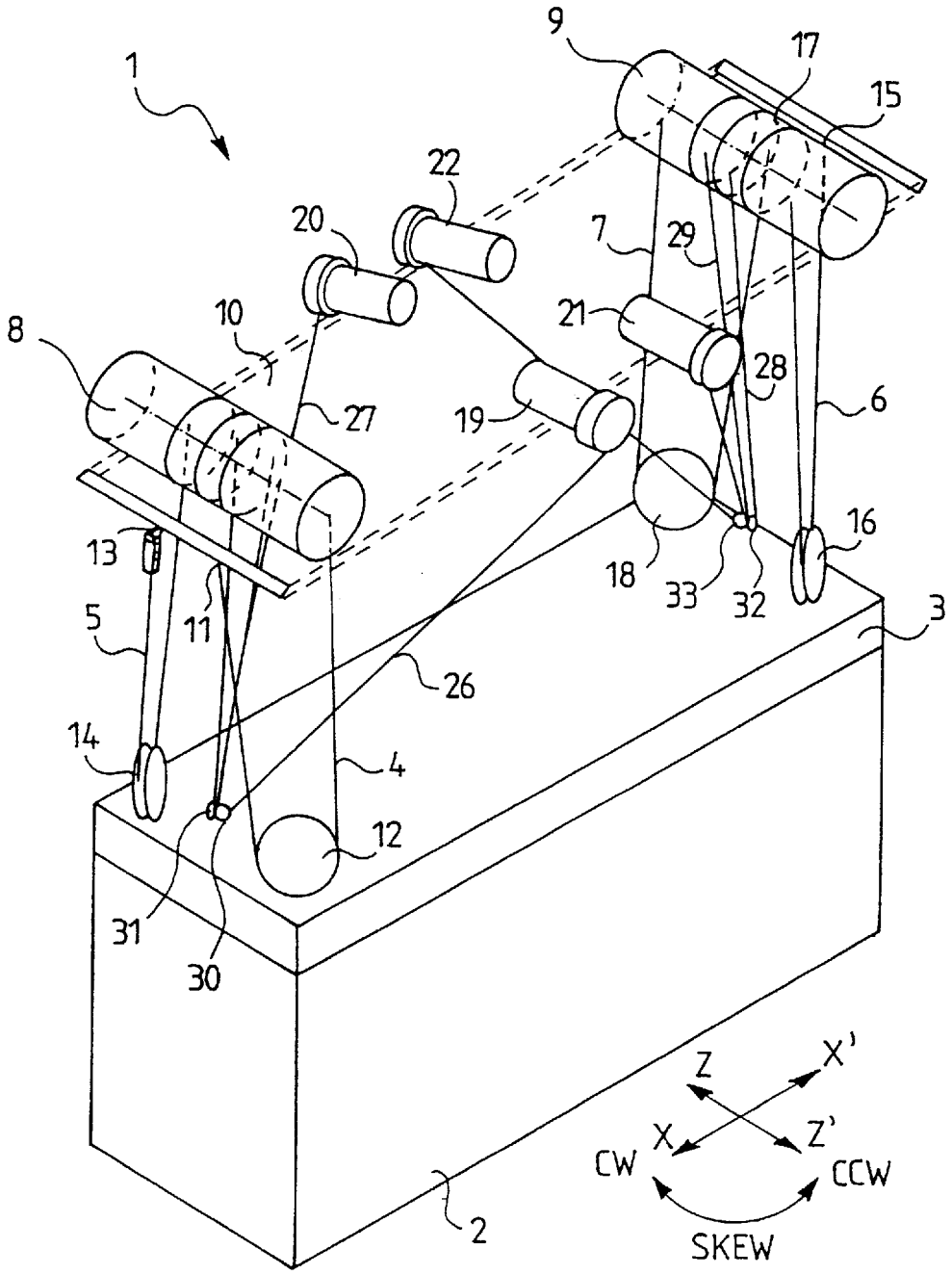

The invention relates to a method and a control apparatus for damping swaying and skew of the loading element suspended from lifting drums of a crane and the load attached to it, and for precision positioning the same in the horizontal direction and in the direction of skew.

Rope-suspended loading elements and loads of a crane tend to sway when the crane is accelerated or decelerated. Swaying of the loading element of a container crane, in particular, is harmful, as the crane should be able to deposit containers with a relatively high accuracy.

A method and apparatus of the type described above are known, for example, from Finnish Patent Application No. 943 401 (Publication No. 96677). In this apparatus, the control of the crane is implemented by a control apparatus consisting of a mechanism beam comprising three mechanically interconnected control mechanisms provided with a motor and a brake. The outermost motors of the mechanism beam comprise double rope drums to which two auxiliary ropes are always connected in such a manner that when one auxiliary rope is unwound from the rope drum, the other auxiliary rope is wound onto it. When swaying is damped and ropes are wound from one drum to another, the mechanism beam is allowed to move in the horizontal direction. The mechanism beam can be further moved in the lateral direction by a third control mechanism, which is positioned in the middle of the mechanism beam and is connected through gearing to the mechanism beam without direct connection to the auxiliary ropes.

The control apparatus disclosed in the above-mentioned application is implemented mainly mechanically, and all directions of movement are mechanically bound to each other.

SUMMARY DESCRIPTION OF THE INVENTION

The object of the present invention is to improve the method and apparatus for controlling the loading element and load of a crane in order to simplify them mechanically, and to allow the control of each auxiliary rope to be controlled independently but even more accurately and reliably than before, which maximizes the control of the loading element.

This is achieved with a control method of the invention, and a control apparatus of the invention, which is characterized by using control mechanisms mounted in the crane, and four auxiliary ropes between the control mechanisms and the loading element.

The present invention is based on the use of four identical but mechanically independent control mechanisms whose control is implemented completely electrically; the control is based on the weighing information of each auxiliary rope and the rotation speed of the motor connected to the auxiliary rope or the drum. There is always a sufficient length of rope in store on a rope drum, which automatically compensates for the different geometry of the auxiliary ropes and the lifting ropes. The forces exerted on each auxiliary rope are adjusted according to instructions given by control logic circuits to prevent the loading element and the load suspended from it from swaying. Both the damping of sway and the precision positioning of the load can be implemented by means of the control apparatus and its control logic circuits. The mechanically simple solution described above is thus achieved with an electric control system.

An essential feature of the invention is the measurement of rope forces of the auxiliary ropes with weighing sensors, and the measurement of the rotation speeds of the motors with tachometers. On the basis of these measurements, target values are calculated for the motor control devices.

According to the invention, each control logic circuit comprises a force controller for achieving and maintaining a desired rope force, a speed controller based on the rotation speed for counteracting skewing of the rope drum and the shaft of the motor, and a preamplifier of the desired rope force for compensating for the effect of force feedback on the moment reference. This sensor arrangement is an essential difference between the present invention and the solution of Finnish Patent Application No. 943 401, where the above-mentioned measurements are not employed.

The controllers are preferably P-/PD-type controllers, which are special types of PID controllers (PID= proportional+integral+derivative). The controllers can be tuned (the parameters of the controllers can be selected) experimentally or by means of a dynamic model of the system.

SUMMARY DESCRIPTION OF THE DRAWINGS

Figure 2:
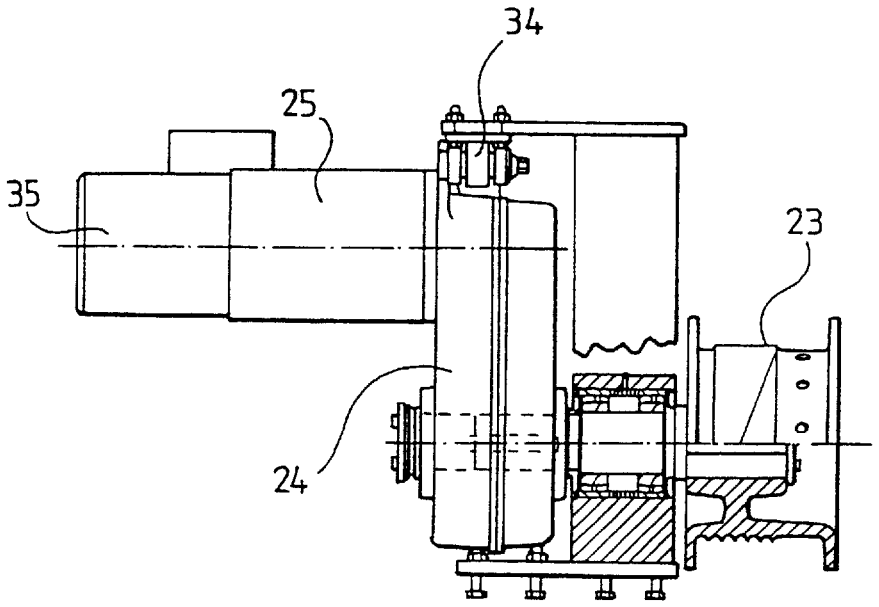
Figure 3:
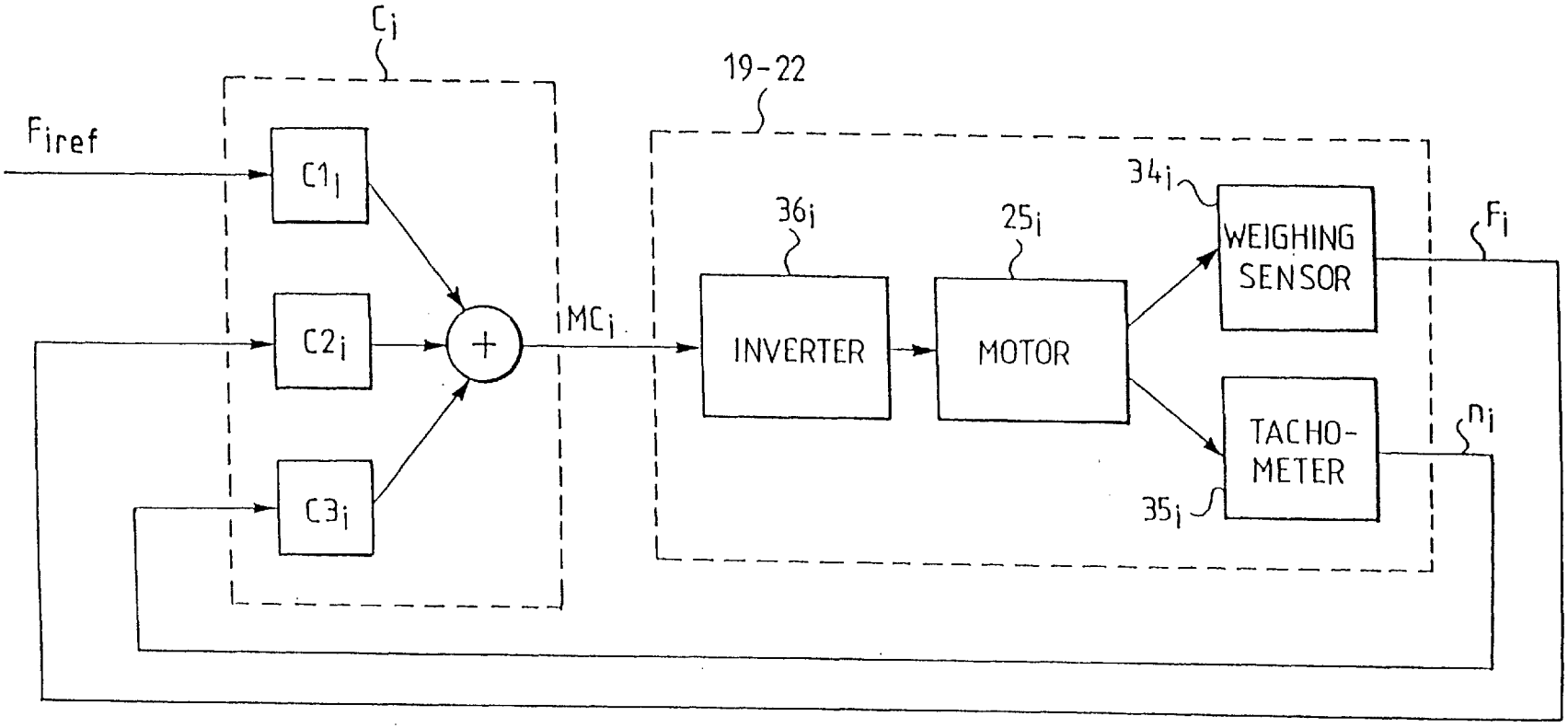

In the following, the invention will be described in greater detail by means of a preferred embodiment with reference to the accompanying drawings, in which FIG. 1 shows the general arrangement of the control apparatus of the invention, FIG. 2 shows a control mechanism of the control apparatus, FIG. 3 is a schematic view of the operating principle of each control mechanism and the control logic circuit connected to it.

Figure 4:
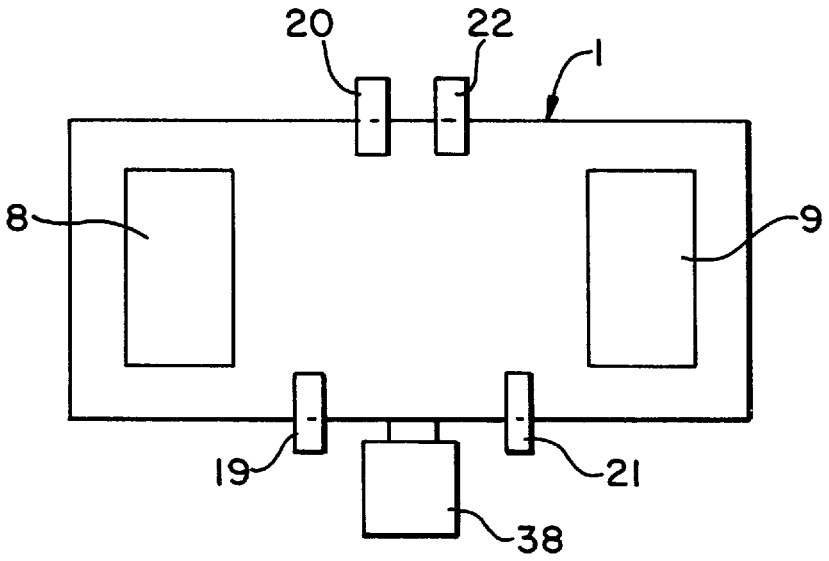

FIG. 4 shows a top view of an example of an asymmetrical arrangement of the control mechanism.

FULL DESCRIPTION OF THE INVENTION

FIG. 1 shows a crane 1 and a load 2, e.g. a container, suspended from a loading element 3 of the crane. The loading element 3 is supported by four lifting ropes 4–7 affixed to a first and a second lifting drum 8 and 9 located above the loading element 3 at a distance from each other.

One end of lifting rope 4 is attached to the crane frame 10 at point 11, from which the lifting rope 4 extends to sheave 12 at a first corner of the loading element 3 and then back up to one side of a first lifting drum 8. One end of lifting rope 5 is attached to the crane frame 10 at point 13, from which the lifting rope 5 extends to sheave 14 at a second corner of the loading element 3 and then back up to the other side of the first lifting drum 8.

Correspondingly, one end of lifting rope 6 is attached to the crane frame 10 at point 15, from which lifting rope 6 extends to sheave 16 at a third corner of the loading element 3 and then back up to one side of a second lifting drum 9. One end of lifting rope 7 is attached to the crane frame 10 at point 17, from which the lifting rope 7 extends to sheave 18 at a fourth corner of the loading element 3 and then back up to the other side of the lifting drum 9.

The direction of the lifting ropes 4-7 from the lifting drums 8 and 9 can be perpendicularly downwards, as the damping of sway is implemented by a control apparatus provided with separate inclined auxiliary ropes. The control apparatus will be described in the following.

The control apparatus mounted in the crane damps the sway of the loading element 3 in both horizontal directions X–X' and Z–Z'; it also damps the skew of the loading element. In addition, the control apparatus can be used for precision positioning, i.e. for shifting the loading element 3 over a short distance in both horizontal directions, and also for skewing the loading element clockwise (CW) and counterclockwise (CCW) for a few degrees.

The control apparatus comprises four identical control mechanisms 19–22 secured to the crane frame 10 in the middle of the space between the lifting drums 8 and 9, for example, in a rectangular formation such that one mechanism is located at each corner of the rectangle. However, it is not necessary to dispose the control mechanisms 19–22 symmetrically, since asymmetry, when it is known in advance, can be taken into account by means of a control system to be described below. In principle, the control mechanisms 19–22 can thus be placed at the corners of an arbitrary quadrangle. The control system allows the control to be implemented by selecting the desired rope force suitably, whereby the asymmetry of the geometry can be compensated for. The problem with the apparatus disclosed in Finnish Patent Application No. 943 401 is that the control mechanisms must be located very accurately at specific positions, which complicates the layout in other respects. Because of the requirements set by the control mechanisms for the layout, it is difficult to position e.g. the cab in the trolley of the crane. FIG. 4 shows how an asymmetrical arrangement of the control mechanisms can make room for the cab 38.

Each control mechanism (see FIG. 2) comprises a rope drum 23 connected through gearing 24 to an electric motor 25, and, between the mechanisms 19–22 and the loading element 3, four auxiliary ropes 26–29, inclined in relation to the vertical direction. The rope drum 23 is of vital importance to the control apparatus. A length of auxiliary rope 26–29 is stored on it, and the ropes are kept as tight as desired by means of a control system which will be described below. Storing the auxiliary ropes 26–29 on the rope drum 23 automatically compensates for the stretching of the ropes. No separate arrangement or calibration at certain intervals is therefore needed on account of the stretching of the ropes.

The control apparatus also comprises four rope groove sections for the auxiliary ropes 26-29 in the middle of the lifting drums 8 and 9. The lifting drums 8 and 9 and the rope groove sections may be provided with conventional rope grooving, or they may be similar to those described e.g. in Finnish Patent Application No. 943 401.

One end of auxiliary rope 26 is attached to a first rope groove section on the first lifting drum 8. From there the rope extends down to a sheave 30 located in the middle of the first end of the loading element 3 and then back up to the rope drum of the first mechanism 19.

One end of auxiliary rope 27 is attached to a second rope groove section on the first lifting drum 8. From there the rope extends down to a sheave 31 located in the middle of the first end of the loading element 3 and then back up to the rope drum of the second mechanism 20.

One end of auxiliary rope 28 is attached to a first rope groove section on the second lifting drum 9. From there the rope extends down to a sheave 32 located in the middle of the second end of the loading element and then back up to the rope drum of the third mechanism 21.

One end of auxiliary rope 29 is attached to a second rope groove section on the second lifting drum 9. From there the rope extends down to a sheave 33 located in the middle of the second end of the loading element and then back up to the rope drum of the fourth mechanism 22.

Each control mechanism 19-22 further comprises (see FIG. 2) a sensor 34 for weighing the rope force of the auxiliary rope, a tachometer 35 for measuring the rotation speed of the rope drum 23 or the motor 25, and a motor control device 36 (FIG. 3) for adjusting the rotation speed (n, FIG. 3) or moment of the motor 25 steplessly. If the motors 25 are AC motors, the motor control device 36 may be, for example, an inverter or a frequency converter. Likewise it is naturally possible to use, for example, DC motors, DC actuators or hydraulic actuators; the control system which will be described below does not impose any restrictions on the selection of actuators.

The control apparatus further comprises four identical control logic circuits C (FIG. 3) connected to and acting on each mechanism 19–22. On the basis of the rotation speed of each rope drum 23 and the weighing information of each auxiliary rope 26–29, the control logic circuits C control the forces (F, FIG. 3) exerted on the auxiliary ropes 26–29 to prevent the loading element 3 from swaying.

As can be seen from FIG. 3, each control logic circuit C comprises a force controller C2 for achieving and maintaining a desired rope force, a speed controller C3 for counteracting skewing of the rope drum 23 and the shaft of the motor 25, and a pre-amplifier C1 of the desired rope force for compensating for the effect of force feedback on the moment reference MC. The subindexes i in FIG. 3 indicate the control logic circuit C connected in each case to one of the four identical mechanisms, the motor 25, the motor control device 36, the weighing sensor 34 and the tachometer 35 of the mechanisms 19–22, and the variables relating to the system in use.

The force controller C2 is preferably a PDcontroller comprising an amplifying portion and a derivative portion, the P-portion being tuned to be slow in order to implement the desired rope force in a balanced state, and the D-portion being used to change the value of the moment reference MC in dynamic situations. The speed controller C3 is preferably a P-controller which comprises an amplifying portion and is tuned to be fast in order to react sufficiently strongly to dynamic situations.

In the case of symmetrically disposed auxiliary ropes 26–29, the same target values can be given to the forces Fi exerted on each auxiliary rope 26–29 when the sway and skew of the loading element 3 is damped. Thus, in a balanced state $F_i=F_{iref}$, i.e. all rope forces $F_i$ are equal, and the rotation speeds $n_i$ of the rope drums 23 are zero.

In the case of asymmetric suspension of auxiliary ropes, the optionally unequal target values set for the forces $F_i$ are such that the horizontal components of the forces $F_i$ compensate each other.

When short shifting movements, or precision positioning, are made in the horizontal direction and in the direction of skew, unequal target values are given to the forces $F_i$ exerted on the auxiliary ropes 26–29. The asymmetric forces of the auxiliary ropes 26–29 thus move the loading element 3 in the desired direction.

The desired tightening $F_{iref}$ of the auxiliary ropes 26–29 can be selected in such a manner that the tightening level is lower with smaller loads than with bigger loads. Thus the mechanisms and motors are loaded as little as possible. The resulting advantages are that the temperature of the motor remains relatively low, and the service life of the mechanisms is lengthened. Furthermore, if the damping property is not utilized, the desired tightening can be selected so that it only keeps the auxiliary ropes 26–29 tight but does not affect the movements of the load 2 and the loading element 3.

In addition, the desired tightening $F_{iref}$ of the auxiliary ropes 26–29 can be selected so that the action of known disturbances (acceleration of shifting movements) is taken into account in advance. Thus it is possible to prepare for a disturbance in advance (e.g. when the shifting movement of the trolley begins) by means of the rope forces (by tightening the auxiliary ropes 26–29 that are on the front side in the direction of acceleration). When the disturbance occurs, the loading element 3 and the load 2 can be kept steady without any sway.

The control sequence of the control logic circuit C can be the moment of the motor 25, which is realized directly by the moment reference MC of a vector-controlled motor control device 36 or, alternatively, as a frequency reference to a scalar-controlled motor control device 36, using feedback to ensure that the desired moment is realized. Moment control can be realized with the same instruments and calculation unit as the rest of the control system; in other words, it does not require any modifications in the apparatus.

The values of the parameters of the control apparatus C are calculated as a function of the lifting height and the load. The tuning of the parameters is calculated experimentally or by means of a dynamic model of the system.

The control system can be implemented by programmable logic (PLC) with floating point number arithmetics. The filtering of measurement signals can be implemented either electrically or by means of software.

The method of the invention is active in the sense that it controls the motors 25 of the control mechanisms 19–22 and prevents the sway of the loading element 3 directly on the basis of the available measurement data. The mechanisms 19–22 and the control logic circuits C form an independent unit, wherefore the damping of sway does not affect the operation of the other mechanisms in the crane at all; in other words, the lifting and shifting movements are independent of the operation of the control mechanisms 19–22.

It will be obvious to one skilled in the art that the invention is not limited to the working example described above, but it can be modified within the scope of the appended claims. Thus, the definition that the apparatus for controlling the sway is mounted in the crane can also mean that the apparatus is mounted in the trolley of the crane. It is also possible to apply the invention to other cranes than container cranes as long as the auxiliary rope arrangement described above can be implemented therein. In addition to the control system described above, the control mechanisms can also be controlled by another kind of system, e.g. by a discrete-model-based system, in which case the .anticipation of disturbances can be implemented optimally. In the case of a discrete-model-based system, it is possible to distinguish between a force controller and a speed controller, but they are not P-/PD-controllers in their structure. Furthermore, it should be noted that the invention allows an empty loading element 3 to be suspended by means of the control mechanisms 19–22 from the auxiliary ropes 26–29, whereby maintenance operations of the lifting mechanisms can be performed without a separate support on which the loading element 3 has to be lowered for the maintenance operations.

We claim:

1. A method for controlling a loading element suspended from a crane by lifting ropes, said controlling referring to damping horizontal sway and skew of the loading element and precision positioning the loading element in the horizontal direction and in the direction of skew by the use of four control mechanisms mounted in the crane and provided with rope drums controlled by respective motors, and four auxiliary ropes respectively connected between the control mechanisms and the loading element, said method comprising;

controlling the control mechanisms to adjust forces exerted on the auxiliary ropes by means of the motors and rope drums based upon measured rope forces and motor rotation speeds, and upon a target rope force;

measuring the rope forces and rotation speeds of the motors connected to the respective auxiliary ropes, each of the control mechanisms receiving the measured rope force and rotation speed of only its own auxiliary rope and motor for use in said controlling step so that the forces exerted on the auxiliary ropes prevent the loading element from swaying;

wherein said controlling step processes the rotation speed of each motor and the measured force of each auxiliary rope separately throuah four respective force controllers for achieving and maintaining a desired rope force, and through four respective speed controllers for counteracting skewing of the corresponding rope drum and skewing of a shaft of the corresponding motor, and further wherein four respective pre-amplifiers preamplify the target rope force for compensating for an effect of force feedback on a moment reference of a corresponding motor.

2. A method according to claim 1, wherein, during damping of sway and skew of the loading element, identical target forces to be exerted on each symmetrically disposed auxiliary rope are used, whereby all auxiliary rope forces are equal, and target rotation speeds of the rope drums are zero, whereby all rotation speeds of the rope drums are zero.

3. A method according to claim 1, wherein the rope drums are positioned asymmetrically so as to form an asymmetric quadrangle, and during damping of sway and skew of the loading element, unequal target forces to be exerted on the asymmetrically disposed auxiliary ropes are used such that horizontal components of the rope forces compensate each other, whereby the auxiliary rope forces keep the loading element in a balanced position, and target rotation speeds of the rope drums are zero, whereby all rotation speeds of the rope drums are zero.

4. A method according to claim 1, wherein, during short shifting movements, or precision positioning, in a horizontal direction and in a direction of skew, unequal target forces to be exerted on the auxiliary ropes are used, resulting in asymmetrical forces on the auxiliary ropes and movement of the loading element in a desired direction.

5. A method according to claim 1, wherein the target forces to be exerted on the auxiliary ropes are anticipated in advance by a dynamic system model to eliminate known disturbance factors, including shifting movements of the crane.

6. A method according to claim 1, wherein the moment reference of a respective one of the motors is realized directly by moment control of a vector-controlled motor control device.

7. A method according to claim 1, wherein the moment reference of a respective one of the motors is a frequency reference to a scalar-controlled motor control device, using force feedback to ensure that a desired moment reference is obtained.

8. A method according to claim 1, wherein said controlling step uses a control logic circuit whose parameters are calculated in advance by a dynamic model of the crane system.

9. A method according to claim 1, wherein the lifting ropes are connected to lifting drums on the crane, and the auxiliary ropes are also connected between the loading element and the lifting drums, thereby allowing the control of the rope drums to make corrections in the suspension of the loading element relative to the lifting drums.

10. An apparatus according to claim 9, wherein a length of auxiliary rope is stored on each rope drum to compensate for the stretching of the auxiliary ropes and the different geometry of the auxiliary ropes and the lifting ropes.

11. An apparatus for controlling a loading element suspended from a crane by lifting ropes, said controlling referring to damping horizontal sway and skew of the loading element and precision positioning the loading element in a horizontal direction and in a direction of skew, said apparatus comprising:

four control mechanisms mounted in the crane and provided with respective motors;

four auxiliary ropes respectively connected between the control mechanisms and the loading elements;

wherein each of said control mechanisms includes a rope drum connected to a corresponding one of said motors, a device for measuring rope force in the auxiliary ropes, and a tachometer for measuring rotation speed of the motor, and a control logic circuit for controlling the corresponding motor element from swaying, and further wherein each control logic circuit includes:

a force controller for achieving and maintaining a desired rope force, a speed controller for counteracting skewing of the rope drum and skewing of a shaft of the motor, and a pre-amplifier for compensating a taraet rope force for the effect of force feedback on a moment reference of the motor, said control logic circuits controlling the motors on the basis of the measured rotation speed and the measured rope force of only its own motor and auxiliary rope.

12. An apparatus according to claim 11, wherein said force controller is a PD-controller having a P-portion tuned to be slow in order to implement the desired rope force in a balance state, and a D-portion used to change the value of the moment reference in dynamic situations, and further wherein said speed controller is a P-controller which comprises an amplifying portion and is tuned to be fast in order to react to dynamic situations.

13. An apparatus according to claim 11, wherein an empty loading element can be suspended by the auxiliary ropes without the lifting ropes or any other separate support.

14. An apparatus according to claim 11, wherein the lifting ropes are connected to lifting drums on the crane, and said auxiliary ropes are also connected between the loading element and the lifting drums, such that control of said rope drums by said control mechanisms can make corrections in the suspension of the loading element relative to the lifting drums.

15. An apparatus for damping skew and horizontal sway of a loading element suspended from a crane by lifting ropes, the loading element having a first elongated dimension and the lifting ropes being connected to a frame of the crane at a first spacing when considered along the first elongated dimension, comprising:

a plurality of auxiliary ropes operatively connected between the loading element and the frame of the crane;

a plurality of rope drums, equal in number to said plurality of auxiliary ropes, for storing portions of the respective auxiliary ropes, said rope drums being connected to the frame of the crane at locations inside the first spacing;

a plurality of motors, equal in number to said plurality of rope drums, respectively connected to said rope drums;

rope force measurers for measuring rope forces in said auxiliary ropes;

tachometers for measuring rotation speeds of said motors; and controller circuitry for controlling said respective rope drums based upon the measured rope forces and the measured rotation speeds.

16. The apparatus for damping skew and sway according to claim 15, wherein there are exactly four rope drums connected to the frame near the center of the first spacing.

17. The apparatus for damping skew and sway according to claim 16, wherein said four auxiliary ropes are connected to the loading element near the ends of the first spacing.

18. The apparatus for damping skew and sway according to claim 17, wherein the loading element includes a length perpendicular to the first spacing, said four rope drums being connected to the frame at a spacing greater than the length.

19. The apparatus for damping skew and sway according to claim 17, wherein the loading element includes a length perpendicular to the first spacing, said four ropes being connected to the loading element near the center of the length.

20. The apparatus for damping skew and sway according to claim 17, wherein one pair of said auxiliary ropes are connected to the loading element immediately adjacent one another, and another pair of said auxiliary ropes are connected to the loading element immediately adjacent one another.

21. The apparatus for damping skew and sway according to claim 16, wherein said four rope drums are arranged to form an asymmetric quadrangle, such that the four rope forces are not identical when the loading element is held at equilibrium.

22. The apparatus for damping skew and sway according to claim 15, wherein said four rope drums are arranged to form an asymmetric quadrangle, such that the four rope forces are not identical when the loading element is held at equilibrium.

23. The apparatus for damping skew and sway according to claim 22, wherein the loading element includes a length perpendicular to the first spacing, said four ropes being connected to the loading element near the center of the length.

24. The apparatus according to claim 15, wherein said controller circuitry controls each rope drum based on the rotation speed of only that rope drum, and on the measured rope force of only the auxiliary rope belonging to that rope drum.

25. An apparatus for damping skew and horizontal sway of a loading element suspended from a crane by lifting ropes, comprising: a plurality of auxiliary ropes operatively connected between the loading element and the frame of the crane;

a plurality of rope drums, equal in number to said plurality of auxiliary ropes, for storing portions of the respective auxiliary ropes;

a plurality of motors, equal in number to said plurality of rope drums;

rope force measurers for measuring rope forces in said auxiliary ropes;

tachometers for measuring rotations speed of said motors; and a plurality of controllers, each respectively connected to one motor, to one rope force measurer, and to one tachometer, such that each controller controls its motor based on the measured rotation speed of that motor, and on the measured rope force in the auxiliary rope associated with that motor.

26. The apparatus according to claim 25, wherein the lifting ropes are connected to lifting drums on a frame of the crane, and each auxiliary rope is connected from a respective rope drum, to the lifting element, and then to one of the lifting drums; and further wherein the lifting ropes have a different angle of inclination than said auxiliary ropes between the lifting element and the frame of the crane such that the lifting ropes have a different geometry than said auxiliary ropes.

* * * * *